United States Patent [19]

Sztancsik

[11] 4,431,003

[45] Feb. 14, 1984

[54] SELF ADJUSTING MEDICINAL SOLE AND/OR MEDICINAL INSTEP-RAISER

[75] Inventor: Tibor Sztancsik, Budapest, Hungary

[73] Assignee: Konsumex Külkereskedelmi Vallalat, Budapest, Hungary

[21] Appl. No.: 338,215

[22] Filed: Jan. 11, 1982

[51] Int. Cl.[3] ..... A43B 7/14

[52] U.S. Cl. ..... 128/594

[58] Field of Search ..... 128/80 D, 586, 594, 128/595, 596, 607, 609; 36/69, 70, 71, 43, 44

[56] References Cited

U.S. PATENT DOCUMENTS

| | | | |
|---|---|---|---|
| 2,366,096 | 12/1944 | Gerber | 128/596 |
| 2,613,455 | 10/1952 | Amico | 128/596 |
| 2,765,545 | 10/1956 | Conrad, Sr. | 128/594 X |
| 2,791,844 | 5/1957 | Horlacher | 128/594 |
| 4,183,155 | 1/1980 | Payne | 128/594 X |

*Primary Examiner*—John D. Yasko

*Attorney, Agent, or Firm*—Gabriel P. Katona

[57] ABSTRACT

The invention relates to a self-adjusting medical sole and/or medical instep-raiser having one or more closed hoses made from flexible material and filled with soft, plastic material, foam, granules, or powder.

The hose starts at a distance of $\frac{2}{3}$ H±5 percent taken from the heel, and is arranged aslant relative to the longitudinal axis of the foot, its length being equal to 4/9 H±10 percent, where H is the longitudinal dimension of the sole lining that can be inserted into the shoes.

The medical instep-raiser can be built into the shoes, or it can be formed in a fashion that it can be removed from the shoes.

5 Claims, 3 Drawing Figures

SELF ADJUSTING MEDICINAL SOLE AND/OR MEDICINAL INSTEP-RAISER

The invention relates to a self-adjusting medicinal sole built into shoes and/or relates to a medicinal instep-raiser adapted to correct the sinking of the arch of the foot and to support the arch uniformly, thereby eliminating complaints caused by static derangement. By self-adjustment is meant that the filling inside the instep raiser and raisers, respectively, takes on—as a result of the weight of the sole of the foot—a spatial form that uniformly supports the arch the best.

The most frequent orthopedic disease of the foot is the plane valgus pronation, which ranges from a slight derangement to severe deformations characterized by ataxia. In some cases the longitudinal and cross arches sink together, while in other cases the valgus position of the heel may cause problems in proper functioning of the foot although the arches are sound. The static problems of the foot and the related symptoms such as pedialgia, swollen ankles, pains in the shins, pains in the knees, backache, and coxalgia can often be derived from a lack of arch support. Accordingly, a well-constructed instep-raiser properly supports and thus secures the arches.

A known method for curing pronation is the stiff instep-raiser. This is made according to a plaster moulding taken from the foot. Static support is obtained with the known method because the plaster moulding is taken in an unladen condition of the leg. Instep-raisers made from elastic plastic foam and an instep-raiser whose height can be adjusted by inserting prefabricated parts are also known.

The drawback of the known methods is that uniform support pressure is not produced on the arch of the foot, and the known methods do not lift the arches gradually. The sick leg endures this heavily and new pains are brought about.

A foot-support shoesole disclosed in Hungarian Patent Specification No. 127,564 is known, which is made from a material that is plastic when warm and sets solid when cool. It is formed inside the shoes by pressure provided while walking. The material, having been transformed temporarily to plastic, e.g., wax, is inserted into the shoes in a bag tightly encasing said material and yields according to the size of the sole, while still not extending. This instep-raiser takes on the shape of the foot or, more precisely, of the sole, but, having been set solid, cannot be flexed, i.e., it does not follow the changes in the shape of the sole during walking.

An orthopedic foot-support shoesole disclosed in Hungarian Patent Specification No. 119.767 is also known, which has an oblong hollow rubber body filled with liquid and, except for the front arch part corresponding to the arch of the foot, is covered by an inductile sheathing. Because the bony frame of the foot, i.e., the shape of the foot, is neither regular nor symmetric, and because the aforesaid specification does not disclose any method that would consider this fact, it does not afford satisfactory solution.

Finally, a rubber bladder foot-support shoesole filled with low-pressure air is disclosed in the Hungarian Patent Specification No. 115.760, the rubber bladder of which consists of an upper and a lower plate, their perimeter corresponding to the elevation of the foot. The plates are adjoined along the periphery with an edge strip, where the width of the strip is chosen in such a way that the air or other gas enclosed in the bladder should be deflected by the weight of the leg only under the arch of the sole. This method does not assure that the arch of the sole is supported by the rubber bladder in proper position, i.e., uniform supporting pressure is not produced under the arch of the sole, and produces pressuresin positions where it is not necessary.

Our experiments show that the object of the present invention can successfully be achieved only if, on one hand, a closed hose forming a longitudinal arch support made from a flexible material is formed and arranged according to certain ratios reflecting the length of the foot and of the sole lining that can be inserted into the shoes, respectively, and on the other hand the hose is filled with a material which permanently has plastic, elastic, and fictile properties.

According to the invention, the closed hose made from flexible material has a roughly scalene triangular shape with heavily rounded corners. Its front end starts at a distance of $B=\frac{2}{3}H\pm5$ percent taken from the heel, where H is the length of the sole of the shoe, and is arranged at an angle $\alpha$ of 5 to 15 degrees from the part of the cross arch next to the toes in the direction of the inner part of the heel. The length C of the hose made from the flexible material is $4/9\ H+10$ percent, while its inner outline connects together in a nearly straight, slightly convex line, the concave line of the sole surface starting at said distance of $B=\frac{2}{3}H\pm5$ percent from the heel and directed under the heel bone. A permanently elastic material of plastic or hydroplastic is employed as filling material.

In a preferred embodiment of the invention, a cross arch support hose advantageously of circular or streamlined shape and made from elastic material is arranged under the longitudinal arch support hose made from flexible material.

The hoses contain a filling of TEROSTAT VII mass, a hydroplastic mass, a crude rubber mass, glassy putty, dough, or any plastic mass, or a material in the form of granules or powder, advantageously dried, sifted sand, or foamed filling, or any combination of same.

In a preferred embodiment of the invention, the medicinal instep-raiser is built into the shoes, its lower plate being the base sole lining of the shoes, and its other plate being the sole lining of the shoes.

A preferred embodiment of the invention will now be described merely by way of example, with reference to the accompanying drawings, to which the invention is not restricted, wherein.

Figure 3:
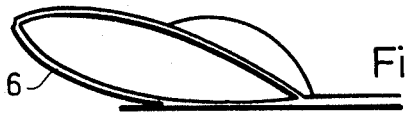
FIG. 3 is a cross-section of the instep-raiser according to FIG. 1.
Figure 1:
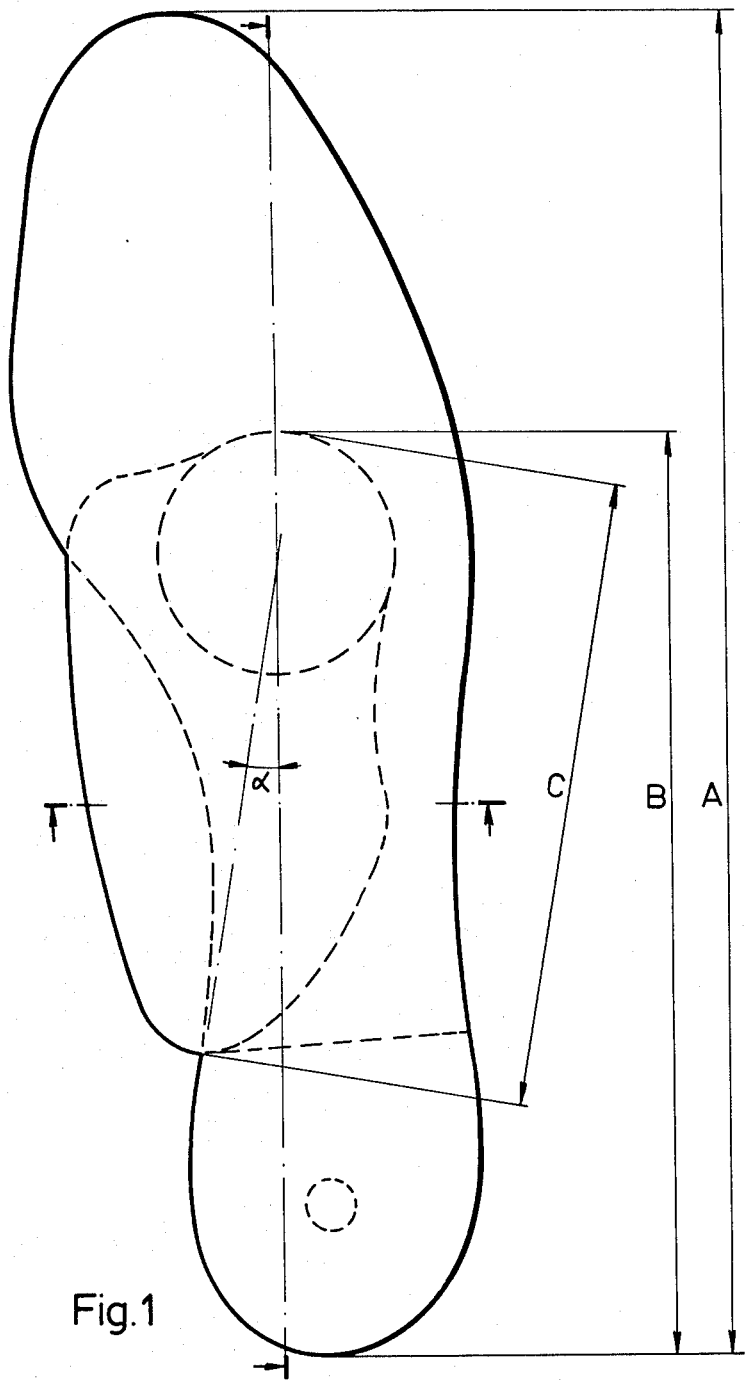
FIG. 1 is a top view of a preferred embodiment of the medicinal instep-raiser.
Figure 2:
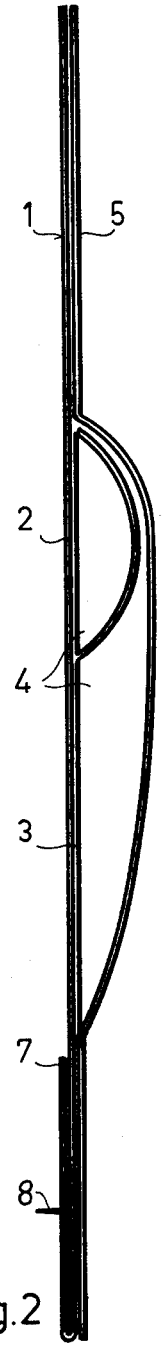
FIG. 2 is a longitudinal section of the instep-raiser according to FIG. 1.

A lower stiffening plate 1 is made from 1 mm thick, hard leather or from FERO fibre leather. Its shape corresponds to the shape and size of the inner sole of the shoes so that it may be inserted easily into the shoes. Its length A is equal to $H-2$ mm. A cross-support hose 2 is affixed to the top of the lower stiffening plate at a distance of $B=\frac{2}{3}H\pm5$ percent, and has a circular or streamlined shape. A longitudinal arch support hose 3 made from a flexible material and for supporting the longitudinal arch is superposed above the cross-support hose, one end of said longitudinal arch support hose 3 being arranged at a distance of $B=\frac{2}{3}H\pm5$ percent taken from the heel, and on the external part of the cross arch proximate to the toes. The longitudinal arch support hose 3 is canted relative to the axis of the foot towards the inside periphery of the lower stiffening plate, being inclined to the inner ankle at an angle $\alpha$ of 5 to 15 degrees in the direction of the inner part of the heel.

The length C of the longitudinal arch support hose 3 made from flexible material is equal to 4/9 H±10 percent. The inner half of the longitudinal arch support hose 3 connects together in an almost straight line with the concave line of the stiffening plate 1 starting from $\frac{2}{3}$ H and directed backwards to under the heel bone. The shape of its external part is formed according to the supporting requirements of the foot. This hose made from flexible material is also affixed to the lower stiffening plate 1.

The hose made from a flexible material can also be produced in a not quite closed arrangement. In this case it is closed by affixing the lower stiffening plate to an upper covering plate 5.

The filling 4 of the hose is TEROSTAT VII mass, hydroplastic mass, crude rubber mass, glassy putty, dough, or any plastic mass, or a material in the form of granules or powder, advantageously dried, sifted sand, or foamed filling, or any combination of them.

The upper covering plate 5 of the medical instep-raiser adjoining to the sole can be made from lining leather, hygroscopic leather or textile.

The upper covering plate 5 and the lower stiffening plate 1 are affixed together. Accordingly, both hoses 2 and 3 are fixed between the two plates.

The inner side of the longitudinal arch support hose 3 that extends out from the lower stiffening plate is provided with an inside cover portion that adjoins the inner part of the shoes and bears up against the inner side of the shoes.

Fixing means 7 and 8 are provided for fixing the instep-raiser inside the shoes.

The embodiment according to the invention can be built into shoes, sandals, slippers or other footwear. In this case, the base sole lining of the footwear plays the role of the lower stiffening plate, while the upper covering plate adjoining the sole surface is substituted by the sole lining of the footwear, and the inner side covering part is substituted by the inner side of the shoes.

The embodiment according to the invention can also be formed from the longitudinal arch support flexible hose alone, because even this can assure crosswise supporting to a small extent.

The pathologically atonic muscles and the flattened bones may not be relifted to their natural position in a single phase because deleterious pressure may be developed that can cause further problems. Accordingly, the filling of the hoses is chosen as to assure gradual lifting. Wearing the instep-raiser is expediently started with a lightly-filled instep-raiser, and when the patient feels himself or herself to have been accustomed to it, better filled instep-raisers may be worn.

One of the main advantages of the embodiment according to the invention lies in that it can be produced simply and cheaply and in the fact that, because it follows perfectly both statically and dynamically the anatomy of the foot, the height of lifting can be set up gradually.

I claim:

1. A self-adjusting medical instep-raiser for insertion in footwear having an interior length H, the instep raiser comprising a lower stiffening plate having the general outline of a sole of a foot with the inside periphery thereof being essentially concave from proximate the toes to the start of the heel, the length of the stiffening plate being equal to or slightly smaller than the interior length H; a closed longitudinal arch support hose of flexible material having a roughly scalene triangular shape with heavily rounded corners affixed to the stiffening plate in the region defining the longitudinal and cross arches of the sole, the hose having its front edge at a distance of $\frac{2}{3}$ H±5 percent as measured from the end of the heel, and being canted at an angle of 5 to 15 degrees with respect to the longitudinal axis of the stiffening plate and proceeding from the cross arch proximate the toes in a direction of the inner part of the heel a distance of 4/9 H±10 percent, the inner outline of the hose connecting with the concave line of the stiffening plate in a nearly straight, slightly convex line; a filling material within the longitudinal arch support hose, said filling material pliantly changing shape in response to variations in the distribution of forces thereon occasioned by movement of the wearer, and an upper covering plate superposed over the hose and affixed to the lower stiffening plate.

2. The instep raiser of claim 1 further comprising a cross arch support hose of flexible material affixed to the lower stiffening plate, said cross arch support hose having a streamlined or circular shape, the cross arch hose being positioned beneath the longitudinal arch support hose such that its front edge is at a distance of $\frac{2}{3}$ H±5 percent as measured from the end of the heel, and a filling material within said cross arch support hose.

3. In footwear of interior length H having a base sole lining having the general outline of a sole of a foot with the inside periphery thereof being essentially concave from proximate the cross and proximate the toes to the art of the heel and a sole lining, an improved self-adjusting insteap raiser comprising a closed longitudinal arch support hose of flexible material having a roughly scalene triangular shape with heavily rounded corners affixed to said base sole lining in the region defining the longitudinal and cross arches of the sole, the hose having its front edge at a distance of $\frac{2}{3}$ H±5 percent as measured from the end of the heel, and being canted at an angle of 5 to 15 degrees with respect to the longitudinal axis of the base sole lining and proceeding from the cross arch proximate the toes in a direction of the inner part of the heel a distance of 4/9 H±10 percent, the inner outline of the hose connecting with the concave line of the base sole lining in a nearly straight, slightly convex line, and a filling material within the longitudinal arch support hose, said filling material pliantly changing shape in response to variations in the distribution of forces thereon occasioned by movement of the wearer, said sole lining covering said longitudinal arch support hose.

4. The improved instep raiser of claim 3 further comprising a cross arch support hose of flexible material affixed to the base sole lining, said cross and support hose having a streamlined or circular shape, the cross arch hose being positioned beneath the longitudinal arch support such that its front edge is at a distance of $\frac{2}{3}$ H±5 percent as measured from the end of the heel, and a filling material within said cross arch support hose.

5. The instep raise of claims 1, 2, 3 or 4 wherein the filling material is selected from the group consisting of TEROSTAT VII hydroplastic, crude rubber, glassy putty, dough, dried sifted sand, foamed filling, or mixtures thereof.

* * * * *